US005170629A

United States Patent [19]

Sindelar

[11] Patent Number: 5,170,629

[45] Date of Patent: Dec. 15, 1992

[54] METHOD AND APPARATUS FOR THE RESTORATION OF THE TURBINE CONTROL RESERVE IN A STEAM POWER PLANT

[75] Inventor: Rudolf Sindelar, Hirschberg, Fed. Rep. of Germany

[73] Assignee: ABB Patent GmbH, Mannheim, Fed. Rep. of Germany

[21] Appl. No.: 748,328

[22] Filed: Aug. 21, 1991

[30] Foreign Application Priority Data

Aug. 21, 1990 [DE] Fed. Rep. of Germany ..... 4026402
Jul. 25, 1991 [DE] Fed. Rep. of Germany ..... 4124678

[51] Int. Cl.[5] ..... F01K 3/00; F01K 13/02

[52] U.S. Cl. ..... 60/652; 60/660; 60/664; 415/14; 415/17; 415/26; 415/19

[58] Field of Search ..... 415/13, 14, 17, 19, 415/23, 26, 27, 28, 29; 60/652, 660, 664, 667

[56] References Cited

U.S. PATENT DOCUMENTS

| | | | |
|---|---|---|---|
| 3,545,207 | 7/1969 | Barber et al. | 60/652 |
| 3,998,058 | 12/1976 | Park | 60/652 |
| 4,178,763 | 12/1979 | Stern et al. | 60/667 |
| 4,246,491 | 1/1981 | Waldron et al. | 60/660 |
| 4,549,401 | 10/1985 | Spliethoff | 60/652 |
| 4,577,281 | 3/1986 | Bukowski et al. | 60/660 |
| 4,728,254 | 3/1988 | Schmitz et al. | 60/652 |

*Primary Examiner*—Thomas E. Denion
*Assistant Examiner*—Mark Sgantzos
*Attorney, Agent, or Firm*—Herbert L. Lerner; Laurence A. Greenberg

[57] ABSTRACT

In conjunction with a method and apparatus for regulating the power of a steam power plant block, an improved method and an improved apparatus for restoration of a given throttling of the turbine inlet valves as a conclusion to a regulating process for stabilizing a sudden or abrupt elevation of the load set point is proposed by the invention. The necessary storage of fresh steam takes place without influencing the electrical output power or the regulating devices necessary for regulating it with the aid of a separate closed control circuit.

6 Claims, 10 Drawing Sheets

Δf=f-f0
PhV
P
Y
PK
PNG
YMAX
YS
PS0
ΔPSε
PST
PSK
Pf1
Pf2
PS
PI
PD
MAX
MIN
S>+0∩S<0
S<-0∩S>0
[YS]>0

Δf=f-f0
15
6
14
Ps
Pf1
Pf2
PST
E2
E1
32
5
E3
A2
A4
A3
A1
11
Ys
NI
10
3
PI
13
2
PI
12
PK
D
B
49
5
4
PD
8
ṁB
44
50
Y
PhV
P

METHOD AND APPARATUS FOR THE RESTORATION OF THE TURBINE CONTROL RESERVE IN A STEAM POWER PLANT

The invention relates to a method and an apparatus for restoring the turbine control reserve by turbine throttling, in the context of a method and apparatus for regulating the power of a steam power plant block.

The method and apparatus for regulating the power of a steam power plant block to which the invention relates are described in German Patent 36 32 041 and portions of that description have been incorporated in this text.

Requirements made of power plant blocks that are involved in primary regulation in the power supply grid are known from the publication entitled "Leistungsregelung im Verbundnetz, heutiges Verhalten der Wirkleistungsregelung und zukünftige Anforderungen" [Power Regulation in the Power Supply Grid; Current Posture and Future Needs in Active Power Regulation], Deutsche Verbundgesellschaft e. V., Heidelberg, November 1980 (Publication 1). Among these requirements for instance are a certain power reserve of a power plant block, and a certain course over time for activating this reserve. These requirements are illustrated in FIG. 1 for fossil-fueled power plant blocks. Accordingly, a power reserve $\Delta P$ of at least 5% of the rated power $P_N$ should be provided, of which at least half must be available within a period t of five seconds, and the entire reserve must be available within 30 seconds.

With a view to the stability of the electrical power supply grid, and to the stability of the steam generation, the course of the block power increase should be strictly monotonic or at least simply monotonic. Three typical courses for block power increase are shown in the patent and will be described below with reference to FIG. 2. Curve I shows a nonmonotonic course of the power increase, which is typical for a power increase by known methods for power regulation. The block power first increases and then drops for a time, and finally rises again. The cause of such an undesirable course is that upon a discontinuous increase of the command power, the previously throttled turbine inlet valve is fully opened immediately, but the thus-released energy supply in the boiler is inadequate to span the period of time until increased fuel delivery produces an adequate power increase. Curve II shows a monotonic rise, in which although the power does not rise steadily, it nevertheless never decreases; and curve III shows a desirable curve, in terms of grid power stability, for the power increase with a strictly monotonic course, or in other words a steadily rising course, until the new command state is attained.

Before a sudden increase in the set point of the block power, an energy reserve provided by a directly regulated throttling of the turbine inlet valve is detected and used to increase the power. Although a rapid power increase is brought about, it is only to such an extent that the energy reserve is adequate to span the period of time—without any temporary lowering of power—until a predetermined long-term power increase is provided by the increased delivery of fuel. Proceeding in this way minimizes the fuel costs for the requisite power performance, since firstly, the energy reserve is adjusted unequivocally and only as needed by the throttling, and secondly, it is used rationally, or in other words for the at least monotonic power increase. The at least monotonic power increase contributes substantially to the stabilization of the supply network.

It was contemplated in the prior art patent, by the forming of compensation signals for the power, position and pressure regulators, these regulators remain largely inactive upon a power increase resulting from a lowering of frequency in the network upon a change in the power set point. This would have meant that changes in fuel and throttling are carried out largely by open-loop control; and only fine regulation is performed by the regulators. The same principle also applies to resuming the throttling after the aforementioned power increase. During this kind of resumption of the throttling, the regulators also remain largely inactive.

Alternative options exist with respect to the steam pressure regulation. Regulating the pressure at the outlet of the evaporator leads to a rapid stabilization in the event of heating malfunctions. However, operating personnel generally prefer to regulate the steam pressure upstream of the turbine.

Fast-acting regulation is attained in the natural sliding pressure mode as well, without changing the circuitry.

FIG. 4 of German Patent 36 32 041 C2 is a block diagram of an apparatus for regulating the power of a steam power plant block, described in the associated text. In particular, the resumption of a predetermined turbine throttling, which occurs automatically as a conclusion of the regulating process if there is a sudden change in the block power, is described as a sub-function of the power regulation.

Resumption of the predetermined throttling takes place in the known apparatus in a controlled manner. This is attained by closure of a feedback switch 38, which sends the valve control signal S to one input of the power/position converter 21. The output signal of the power/position converter, namely the fed-back valve control signal S, is used to control the delivery of fuel, specifically by carrying the signals to the seventh function generator 39 via the switch 37.

As mentioned above, an object of the method described in German Patent 36 32 041 was that the power regulation should remain largely inactive during the resumption of the turbine throttling. It has been found in practice that this object is not fully attainable. The resumption of the turbine throttling means that the signal S is changed to zero. As a result, the turbine regulating valves close and the fresh steam pressure rises. Since the steam pressure does not vary in a delay-free manner, a temporary lowering of the electrical power occurs as a result, even if the fuel is temporarily increased at the same time by means of a seventh function generator 39 shown in FIG. 4. The malfunctioning electrical power must be stabilized by the power regulation; that is, it cannot become or remain inactive during the resumption of the turbine throttling as desired. The method and apparatus are also intended to be used for power plant blocks that operate in the combined fixed and sliding pressure mode.

It is accordingly an object of the invention to provide a method and an apparatus for restoring the turbine control reserve after the stabilization of a power set point change in a steam power plant block, which overcomes the hereinafore-mentioned disadvantages of the heretofore-known methods and devices of this general type and to provide a method and an apparatus for resumption of the turbine throttling which optionally also works in the combined fixed and sliding pressure mode.

With the foregoing and other objects in view there is provided, in accordance with the invention, in a method for controlling the power of a steam power plant block with the aid of a control system including a function generator, a power/position converter and a summation point, in which a steam reserve that is available as a turbine adjustment reserve is utilized for briefly raising the power by means of throttling a turbine inlet valve or closing a last or even next-to-last turbine control valve, a novel method for restoring a predetermined turbine adjustment reserve by turbine throttling after a stabilization of a sudden elevation in the load set point of the steam power plant block, wherein a turbine inlet control signal for controlling a turbine inlet valve setting has the value of zero in a steady state in a sliding pressure mode, which comprises:

varying the turbine inlet control signal as a function of a predetermined load set point variation for utilizing the steam reserve and effecting a change in the turbine inlet valve position, and subsequently returning the turbine inlet control signal to zero in a regulated manner, by feeding an output signal of a power/position converter to a regulator and effecting a change in a fuel control signal and thus in a fuel delivery to the power plant block, specifying a set point zero to the regulator for causing the output signal to act as a control difference, and feeding back the fuel control signal to the function generator, the power/position converter and the summation point of the control system for influencing and forming the turbine inlet valve control signal.

In accordance with a further mode of operation, PD regulator is used as the regulator having P and D components, and the method comprises activating the D component only whenever a logic circuit furnishes a logical 1, furnishing a logical 1 with the logic circuit if the output side to be regulated is more positive than a predetermined value and varies in the negative direction, or if the output signal is negative and smaller than a predetermined value and varies in the positive direction.

In accordance with another mode of operation, the signal S is not returned to zero in the case of an increase in block power to a power level in the fixed pressure range, but instead the turbine inlet valve control signal is brought to a valve control set point dependent on a load set point and a valve position set point.

Accordingly, the object of the invention is attained by the method for resumption of a predetermined turbine throttling after a stabilization of a sudden elevation in the power set point of a steam power plant block, this method being part of a method for regulating the power of a steam power plant block with the aid of a control system, in which a steam reserve that is available as a turbine adjustment reserve by means of throttling the turbine inlet valve or closing the last or even next-to-last turbine regulating valve is utilized for briefly raising the power. A turbine inlet control signal, which in the steady state or inertia condition in the sliding pressure mode has the value of zero, and which for utilizing the steam reserve is varied as a function of a predetermined power set point change and effects a change in the turbine inlet valve setting, is brought back to the value of zero once the power regulating procedure has taken place, and wherein the turbine inlet valve control signal is brought to zero in a regulated manner. This is attained in that a) an output signal of a power/position converter is carried to a regulator, which effects a change in a fuel control signal and thus in the fuel delivery to the power plant block, wherein a set point of zero is specified to the regulator, as a result of which the output signal acts as a control difference, and that b) the fuel control signal is fed back to elements of the regulating system for influencing and forming the turbine inlet valve control signal.

With the objects of the invention in view there is further provided an apparatus for regulating the power of a steam power plant block by utilizing a steam reserve available as a turbine adjustment reserve for briefly raising the power, comprising a regulator having an input and an output, a power/ position converter for forming a turbine inlet valve control signal to be fed to said input of said regulator, means for additively linking a signal from said output of said regulator with a further signal for forming a fuel control signal, a function generator receiving said fuel control signal for generating a function signal, summation point means for forming a summation signal by linking said function signal with a signal dependent on a load set point, and means for delivering said summation signal to said power/position converter as an input signal.

In accordance with a concomitant feature of the invention, the regulator is a PD regulator having a P and a D component, and the apparatus further includes a logic circuit connected to the PD regulator for controlling the D component as a function of predetermined conditions.

Accordingly, the object of the invention is further attained by an apparatus for carrying out the described method. As mentioned, the apparatus includes a regulator, to which as its input signal a turbine inlet valve control signal formed by a power/position converter is delivered, and the output signal of which is additively linked with a further signal for forming a fuel control signal, which is delivered to the power/position converter as an input signal via a function generator and an summation point, with linkage with a signal dependent on a load set point.

The invention has the advantage that the storage of energy on the steam side takes place while the electrical output power remains completely constant, the associated regulators for the electrical power remaining inactive.

In a preferred embodiment a PD regulator is used, the D component of which is activated by a logic circuit; as a result, a particularly well-damped course of the automatic resumption of throttling is attained.

Other features which are considered as characteristic for the invention are set forth in the appended claims.

Although the invention is illustrated and described herein as embodied in a method and apparatus for restoring the turbine control reserve after the stabilization of a set point change in a steam power plant block, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection figures of the drawings, in which.

Figure 1:
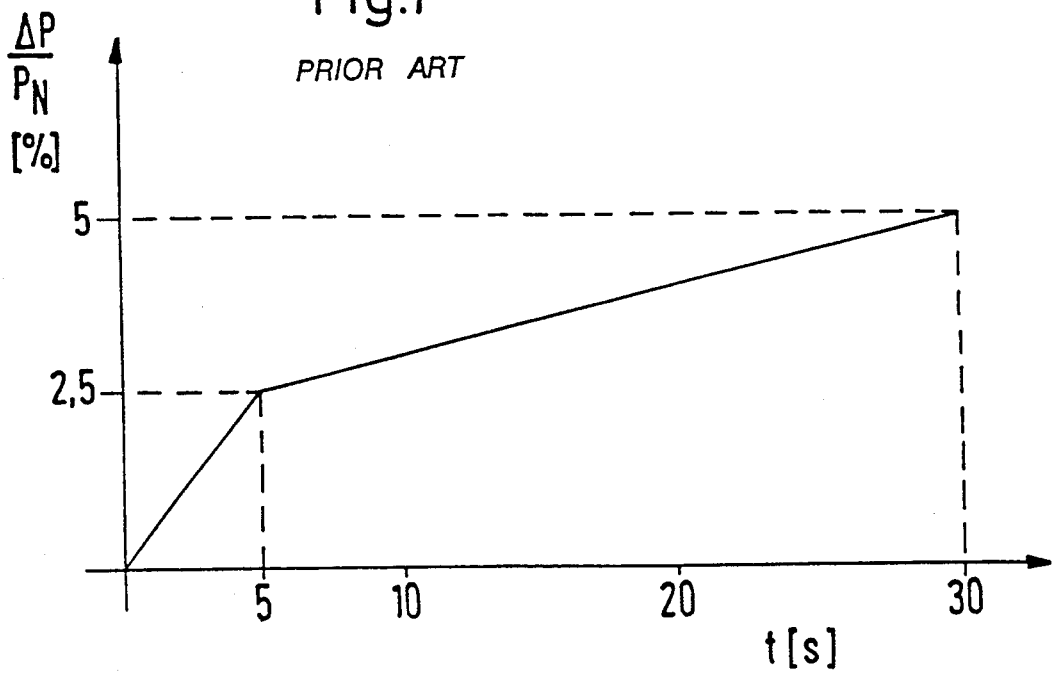
Fig.1 PRIOR ART
FIG. 1 is a diagram of the Deutsche Verbundgesellschasft requirements for the power reserve of a power plant block, and the course over time for activating the reserve.
Figure 2:
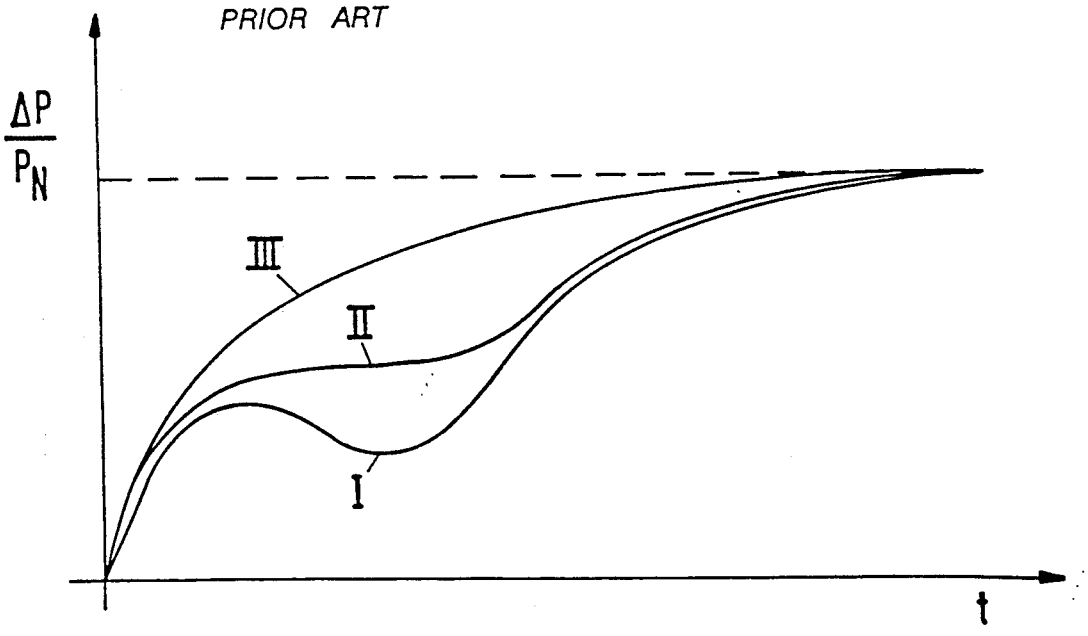
Fig.2 PRIOR ART
FIG. 2 is a diagram of three typical courses for a block power increase.
Figure 3:
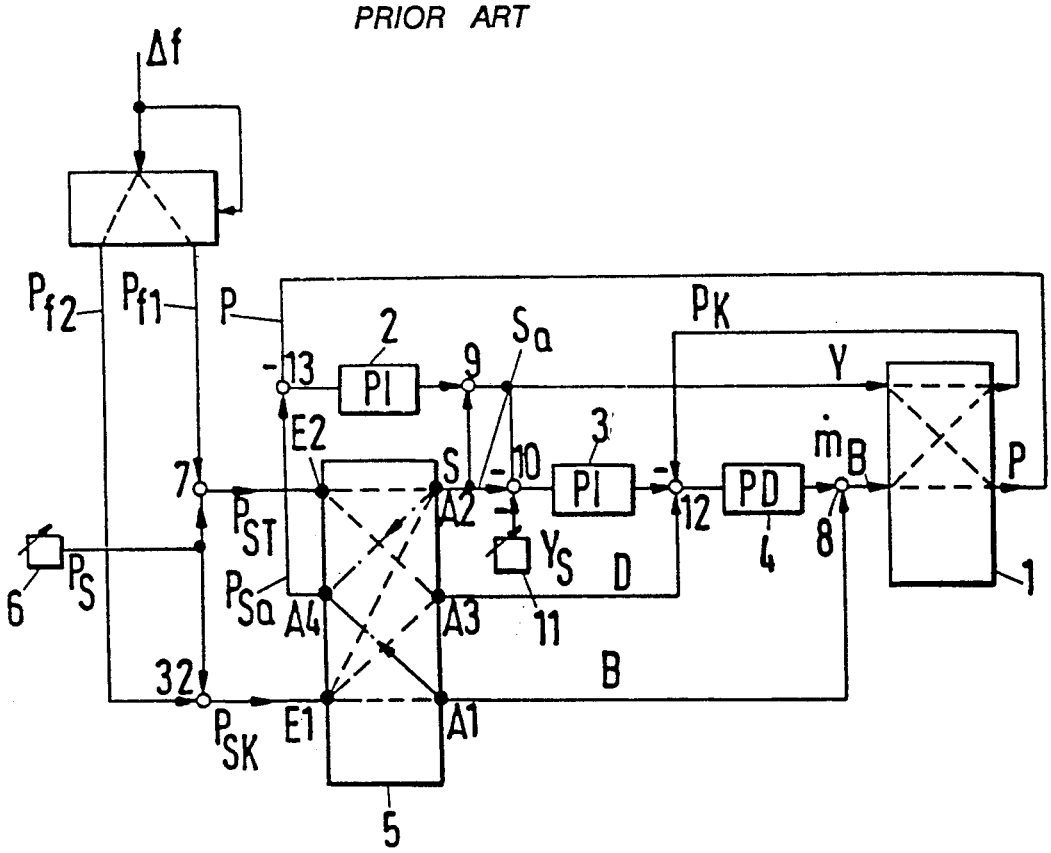
Fig.3 PRIOR ART
FIG. 3 is a basic circuit diagram of a prior art apparatus for controlling the power of a steam power plant block, in the block operating mode known as "turbine leads, boiler follows"
Figure 4:
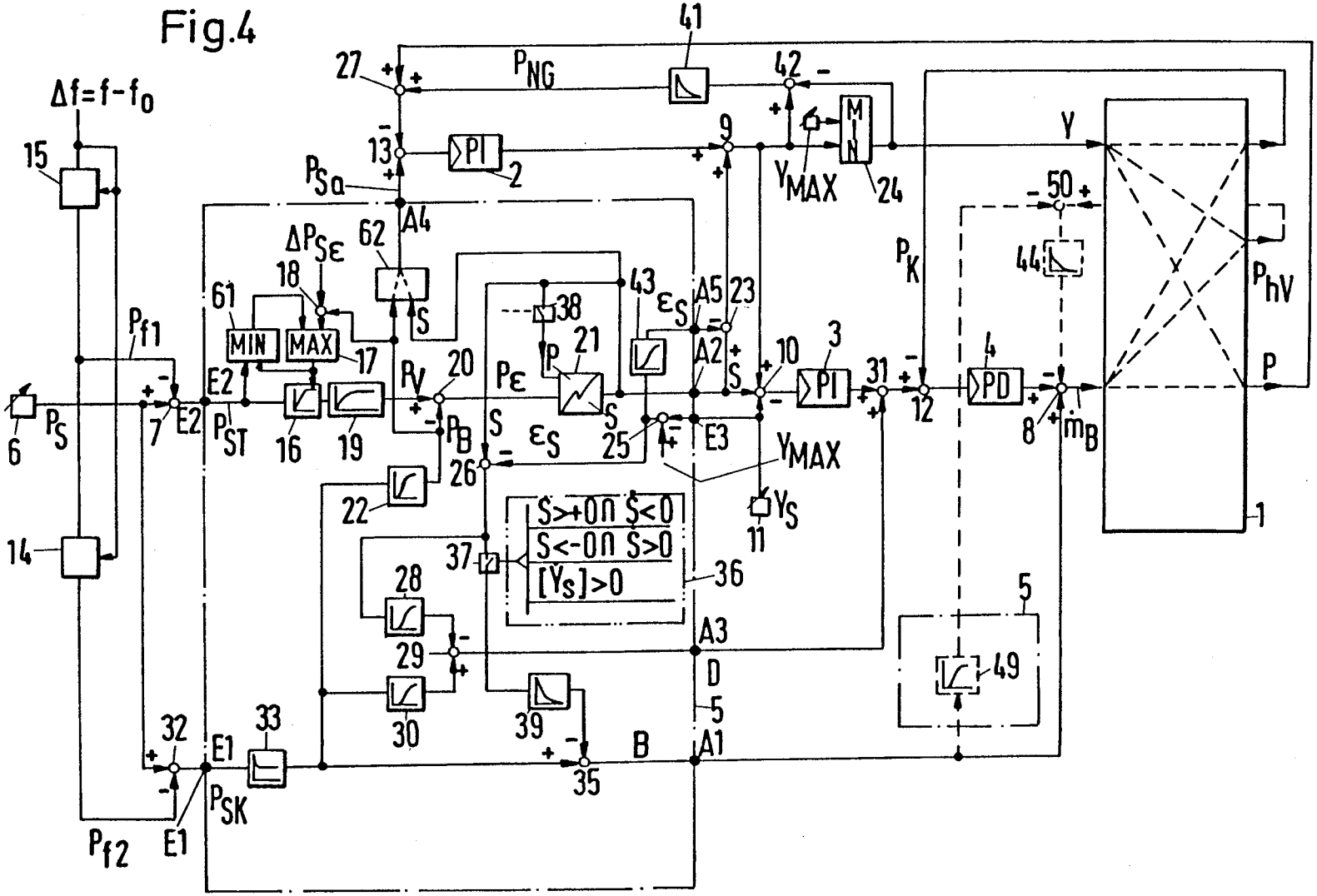
FIG. 4 is a block diagram of the apparatus according to the invention.

Referring now to the figures in detail, it is noted that FIGS. 1–3 and 4a–10 are prior art drawings taken from German Patent 36 32 041. FIG. 4 largely corresponds to that of the German Patent, and changes according to the instant invention were made in that original FIG. 4 and the essential control circuit of the instant invention has been emphasized with slightly heavier lines.

The drawings principally show an apparatus for controlling and regulating a power plant block 1 with the aid of a power regulator 2, a position regulator 3, and a steam pressure regulator 4. The power regulator 2 regulates a power P output by the power plant block 1; the position regulator 3 regulates a trigger signal valve position Y, and the steam regulator 4 regulates a fuel flow rate $m_B'$. At this point it is noted that the "'" in the text denotes a first derivative and corresponds to the "*" denotation in the drawings. A coordinated process model 5 simulates the dynamic behavior of the process, for instance including an energy reserve provided for throttling. The method for resumption of the turbine throttling that is changed according to the invention, and the corresponding changes in the associated apparatus, will become apparent from the description below of the features emphasized in the drawing.

In the basic circuit diagram of FIG. 3, reference numeral 1 designates a power plant block that is guided by the open-and closed-loop control apparatus shown. A power regulator 2, a position regulator 3 and a steam pressure regulator 4 are provided as regulators. The power regulator 2 regulates an electrical power P output by the power plant block 1. There is a linear relationship in the steady state, given a constant fresh steam pressure, between the power P, also known as the block power, and a trigger signal Y for the position of the turbine inlet valve (hereinafter called the valve position Y for short). The valve position Y signal is to be considered a joint trigger signal for generally a plurality of parallel or series-connected valves. It should also be noted that the trigger signal designated as valve position Y is not identical with the actual valve position, because of the nonlinear behavior of the turbine inlet valves. The trigger signal valve position Y is regulated with the position regulator 3. The fuel flow rate $m_B$ is influenced by the pressure regulator 4. Any change in the fuel flow rate $m_B$ must necessarily be accompanied by changes in the air flow rate and feedwater flow. This is done in accordance with regulating circuits, which are known per se in the prior art. For the sake of simplicity, these two additional—besides the fuel flow rate $m_B$ and valve position Y—control interventions in the power plant 1 of FIG. 3—and elsewhere—will therefore not be shown here. The steam pressure $p_K$ can be picked up (measured) either downstream of the boiler evaporator or downstream of the boiler or upstream of the turbine.

A coordinated process model 5 is also provided, which simulates the dynamic behavior of the process and among other factors uses an energy reserve defined by the valve position Y, or in other words by the throttling $\epsilon$, rationally for increasing the power, as will be described in further detail hereinafter. The term "throttling $\epsilon$" represents the difference between the fully opened valve position $Y_{max}$ and the actual valve position Y.

Power set points or set points $P_{SK}$ and $P_{ST}$ are fed to inputs E1 and E2 of the process model 5. These load set points are formed by addition of a load set point PS, output by a load set point setter 6, and a load set point component $P_{f1}$ and $P_{f2}$ at a first guide variable summation point 7 and at a second guide variable summation point 32, respectively. The load set point components $P_{f1}$ and $P_{f2}$ are formed by weighting a deviation $\Delta f$ of the network frequency f from a command frequency $f_0$, as will be described in further detail below in conjunction with the description of FIG. 4.

With the aid of the steady-state and dynamic behavior of the power plant block 1, simulated in the process model 5, control signals B and S are formed, for instance upon a sudden increase in the load set point $P_S$, for generating steam by delivering fuel and for dispensing and storing the energy in the boiler by cancelling or partly cancelling the throttling $\epsilon$ the turbine inlet valve. The fuel control signal B, output via an output A1 of the process model 5, influences the fuel flow rate $m_B$ via a fuel value summation point 8. The valve control signal S output via an output A2 of the process model 5 acts directly to control the valve position Y of the turbine inlet valve, via a first control valve summation point 9.

Changes in power, such as sudden increases, lead to a controlled adaptation of the possible dispensing of energy by varying the valve position Y, and to the fastest possible controlled increase in steam production. To this end, for a given command course of the power P, the control signals S, B which have been ascertained are input to the various control variable Y, $m_B$ of the power plant 1, and at the same time, as compensation signals, a predetermined load set point $P_{Sa}$ is input to the power regulator 3, a valve position compensation signal $S_a$ is input to the position regulator 3, and a pressure set point signal D is input to the pressure regulator 4. The valve position compensation signal Sa is identical with the valve control signal S, and the course over time is identical with the corresponding control variable, valve position Y; the predetermined load set point $P_{Sa}$ and the pressure command valve signal D have approximately the same course over time as the corresponding control variables, power P and steam pressure $p_K$. The corresponding control variables P, $p_K$ and Y are the dynamic response to the fuel control signal B and the valve control signal S.

A valve position set point $Y_S$ output by a valve position set point transducer 11, to which set point the valve position Y is stabilized after each change in power, is carried to a second control value summation point 10.

A pressure valve summation point 12 is disposed upstream of the steam pressure regulator 4, and the output of the position regulator 3 is carried to it as a correction signal —the output signal of the position regulator varies practically not at all in the controlled power change—the output being a steam pressure signal $p_K$ with a negative algebraic sign measured upstream of the turbine inlet valve, for instance, and the pressure set point signal D output by the process model 5 at the output A3. As a result, it is attained in this prior art mode that the pressure regulator 4, too, remains substantially inactive during the control process.

The electric power P measured at the output of the power plant block 1 is carried with a negative algebraic sign to a power value summation point 13 upstream of the input to the power regulator 2. As a compensation signal, the predetermined load set point $P_{Sa}$ that is output by the process model 5 at the output A4 is also carried to this summation point 13. The course of the predetermined load set point $P_{Sa}$ over time represents the actual power course to be achieved by means of the control signals F and B. As a result, the control deviation of the power regulator 2 remains practically zero.

With the arrangement shown in the form of a basic diagram in FIG. 3 it is accordingly attained that upon a sudden, for instance discontinuous, increase in the load set point $P_S$, the regulators 2, 3, 4 remain largely inactive. The required change in throttling $\epsilon$ and fuel delivery is brought about primarily in controlled fashion. The formation of the requisite control and correction signals, namely B, S, D, $P_{Sa}$, is done in coordinated fashion in the process model 5. The coordination is such that a predetermined strictly monotonic, or at least simply monotonic, transition to a higher electrical power is attained.

To enable regulating the valve position Y to a set point, a PI regulator, that is, a regulator with an I channel, is necessary as the position regulator 3. The controlled segment for the position regulator 3 comprises the power plant block 1 (technological control segment) and the closed power control loop having the power regulator 2 performing with PI behavior. This controlled path lacks compensation; it is provided with the P performance by means of the disposition of the steam pressure regulator 4 as a subordinate regulator.

With this closed-loop control concept, it is attained that the desired throttling $\epsilon$ is established only indirectly and hence roughly by the furnished pressure set point D and the pressure regulator 4, but also directly and therefore accurately by the position regulator 3. As a result, both the electrical power P and the throttling $\epsilon$ are stably regulated to their set point values.

With the control structure as depicted, it is possible to operate in modified sliding pressure mode (in which the turbine inlet valve is throttled) and—without any change in circuitry—in the natural sliding pressure mode.

FIG. 4 is a block diagram for the apparatus for carrying out the method of the invention shown already in FIG. 3 in the form of a simplified basic circuit diagram. The relationship of circuit elements already shown in FIG. 3 is the same, so that essentially only the additional circuit elements need to be described.

As already noted for the basic circuit diagram of FIG. 3, load set point components $P_{f1}$ and $P_{f2}$ that are dependent on the network frequency deviation are provided as guide variables for the load set point $P_S$; the first load set point component $P_{f1}$ takes into account changes in a network frequency deviation in a first frequency range, which can be adopted by the steam turbine, and the second load set point component $P_{f2}$ takes into account only low-frequency changes in a second frequency range, which can be adopted by the steam generator. The load set point components $P_{f1}$ and $P_{f2}$ are formed in filter devices 14, 15, to which a frequency deviation $\Delta f$ is supplied. The frequency deviation $\Delta f$ represents the difference between a measured network frequency f and a set point frequency $f_0$ (50 Hz).

Superimposed on the "frequency deviation" signal $\Delta f$ is a noise signal which is filtered out in the filters 14, 15, which in principle has a PT1 behavior (proportional element with first order delay element), for instance. Such filters for the network signal are known in the prior art. However, the filters known from the prior art in principle maintain their PT1 behavior even in the event of a dip in the network frequency. Only the time constant is changed in the case, for instance being reduced by one order of magnitude. The filter arrangement exhibits PT1 behavior. A dip in network frequency is characterized by an exponential course of $\Delta f$, or in other words with an initially slope-like drop. The same course is also exhibited by the load set point components $P_{ST}$ and $P_{SK}$. With such a course, the set point value components $P_f$, however, cannot fully exploit the already existing dynamic characteristic of the power plant block, which is characterized by the PT1 power discontinuity response.

Figure 4A:
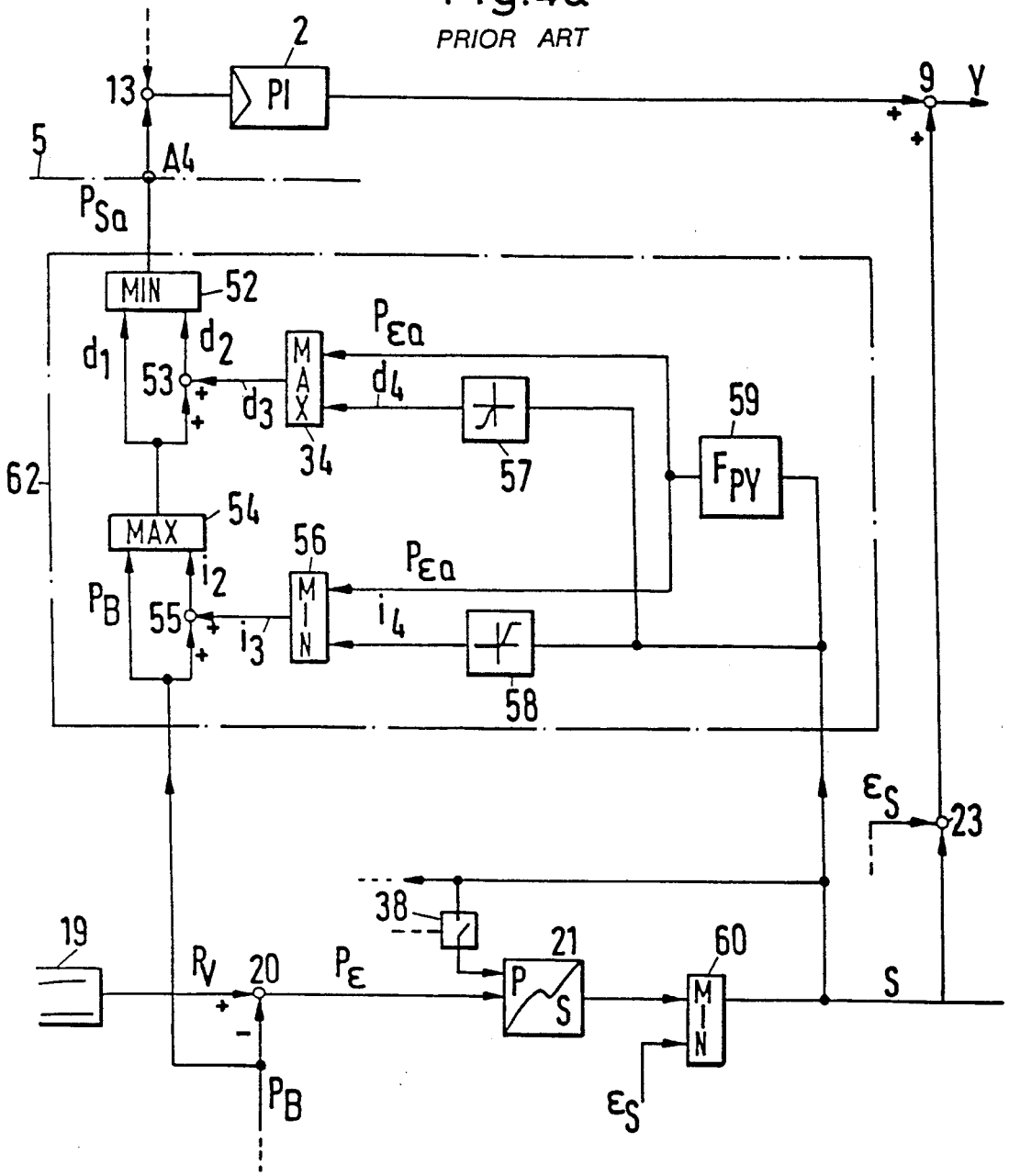
Fig.4a PRIOR ART
FIG. 4a is a detail of a prior art function generator, shown in FIG. 4, for a predetermined load set point value.

To improve the dynamic behavior upon a sudden reduction in network frequency, a nonlinear adaptive filter device, which is described in detail and depicted in the FIG. 4a of the above-mentioned German patent, is therefore provided as a filter 15 for forming the set point component $P_{f1}$ in the configuration according to the invention shown in FIG. 4. This filter device 15 is distinguished by the fact that its behavior upon a drop in network frequency changes from PT1 to PDT1. The filter device 15 includes a detector device for this purpose, to detect a dip in frequency and to cause the change in function of the filter from a PT1 behavior to a PD behavior. Not until a new steady state is attained does the PT1 behavior become operative again. With the set point component $P_{f1}$ formed in the filter 15, the dynamics of the power plant block provided with the apparatus shown in FIG. 4 and described below can be employed to their full extent for primary frequency regulation.

The first load set point component $P_{f1}$ is delivered to the guide variable summation point 7 with a negative algebraic sign; there the component $P_{f1}$ is added to the load set point $P_S$ output by the set point setter 6, as a result of which a load set point for the turbine $P_{ST}$ is produced that is delivered to the input E2 of the process model 5.

The second power component $P_{f2}$ is delivered to the second guide variable summation point 32 with a negative algebraic sign and is added there to the load set point $P_S$. The result is a load set point $P_{SK}$ for the boiler, which is carried to the input E1 of the process model 5.

Further description of FIG. 4 will be made by describing the function. To this end, an operating situation is selected in which a fictitious dip in network frequency occurs, as a result of which an equally large discontinuity in the load set point $P_{ST}$ for the turbine and the load set point $P_{SK}$ for the boiler is assumed.

As a result of the discontinuous change in the load set point $P_{SK}$ for the boiler, the set point for the fuel flow rate $m_B$ is varied in a controlled manner. This is done by carrying the value $P_{SK}$ from the input E1 of the process model 5 to a fifth function generator 33. The term "function generator" here in each case indicates a block or member having dynamic behavior. The output of the fifth function generator 33 is delivered to the output Al of the process model 5 as a fuel control signal B, and from there is delivered to the power plant block 1 via the fuel value summation point 8. As a result, because of the altered specification of the flow rate $m_B$, the thermal power of the boiler in the power plant block 1 is increased. The function generator 33 assures a certain derivative action for the accelerated power increase.

The output of the function generator 33 is also carried parallel to a second function generator 22. The second function generator 22 simulates the course over time of the fuel-dependent power $P_B$, and this course is the response to the change in the load set point $P_{SK}$ or to the thereby altered set point B for the fuel.

Because of the discontinuous change in the load set point for the turbine $P_{ST}$, the position Y of the turbine valves is as a result adjusted in controlled fashion—with the same algebraic sign.

The function of the process model 5 can be best understood with the aid of the prior art FIGS. 6a–6c with regard the handling of the load set point $P_{ST}$. In FIG. 6a, a discontinuous increase in the load set point $P_S'$ is shown, by an amount $\Delta P_S'$. The symbol $P_S'$ represents a load set point that applies equally for both the boiler and turbine; that is, $P_S'=P_{SK}=P_{ST}$.

FIG. 6b shows a course, predetermined by the process model 5, for the block power P as a response to the increase in the load set point $P_S'$. FIG. 6b relates to a situation in which throttling $\epsilon$ is provided high enough so that a strictly monotonic total course of the block power P over a time range $t_0$ to $t_2$ can be realized. The discontinuous change in the set point $P_S'$ takes place at time $t_0$. At time $t_2$, the increased amount of the block power P is attained, which also persists. If the energy reserve prevailing as a result of throttling $\epsilon$ were not used, the block power P would vary approximately according to the course of the fuel-dependent power $P_B$. The process model 5 ascertains the course to be expected of the fuel-dependent power $P_B$ and calculates a differential power, which is the throttling-dependent power $P_\epsilon=P-\Delta P_B$, and which at any moment within the time range $t_0$ through $t_2$ is composed of a fuel-dependent power increase $\Delta P_B$ and a throttling-dependent power $P_\epsilon$, by varying the throttling variation $\Delta P$ of the total power P.

FIG. 6c shows a situation in which an existing throttling $\epsilon_1$ is inadequate for the desired amplitude $\Delta P_S'$ of a predetermined strictly monotonic course of the block power P, but instead is adequate only for a monotonic course $P_1$ of the block power. The entire energy reserve provided by the throttling $\epsilon$ is now used for a strictly monotonic course of power in an initial range $t_0$ through $t_1$. In the initial range $t_0$ through $t_1$, the effective throttling-dependent power $P_{\epsilon 1}$ is ascertained as a power difference between a predetermined power course $P_1$ and the fuel-dependent power $P_B$. At time $t_1$ the energy reserve from the throttling $\epsilon_1$ is used up, and the total course $P_1$ of the block power follows the course of the fuel-dependent power $P_B$. For predetermining the course $P_1$ of the block power in the initial range $t_0$ through $t_1$, a reduced block power increase $\Delta P_S'$ is made the basis, compared with the preceding situation.

Again with respect to FIG. 4, the load set point for a turbine $P_{St}$ is carried from the input E2 of the process model 5 to the input of a power amplitude limiter 16. There a check is made as to whether a strictly monotonic actual block power course, set or predetermined in a function generator 19 connected to the output side, is feasible with the prevailing throttling (for instance, $\epsilon_1$). Only a portion of the amplitude of the increase to be made in the load set point $P_{ST}$ is allowed through by the power amplitude limiter 16 and via the function generator 19 to reach the eighth summation point 20, in other words, the course $P_V$, which can be achieved by the existing throttling $\epsilon_1$ at the existing course of the fuel-dependent power $P_B$ as a dynamic response to the fuel control signal B.

The situation will first be considered in which the entire amplitude of the increase of the load set point $P_{ST}$ (or $P_{SK}$, since $P_{ST}=P_{SK}$) can be achieved with the existing throttling $\epsilon$ as a strictly monotonic rise in the output block power P, the course of which is determined by the setting of the dynamic behavior of the first function generator 19. At the eighth summation point 20, the fuel-dependent power $P_B$ is subtracted from the output signal $P_V$ of the first function generator 19, so that the throttling-dependent power $P_\epsilon$ is obtained, which must be met from the energy reserve by varying the throttling $\epsilon$. The output signal $P_\epsilon$ of the eighth summation point 20 is delivered to a power/position converter 21, which forms the valve control signal S and passes it to the output A2 of the process model 5.

The valve control signal S is carried to the first control value summation point 9, where it is added to the output signal of the power regulator 2, thus producing the trigger signal Y for the position of the turbine inlet valve, which via a second selection element 24 is carried to the turbine inlet valves as a control signal of the power plant block 1. The valve position is varied by the trigger signal Y, and its effect on the output block power P is simulated by a thirteenth function generator 62. A power component obtained in this way, together with the fuel-dependent power $P_B$, produces the predetermined load set point $P_{Sa}$ at the output A4 of the process model 5. At the power value summation point 13, the block power P that is carried from the power plant block 1 to the power value summation point 13 via a sixteenth summation point 27 is subtracted from the predetermined load set point $P_{Sa}$. The sixteenth summation point 27 further receives a balanced or simulated load signal $P_{NG}$ from a 9th function generator 41 , which is fed from a 17th summation point 42 with the signal difference between $Y_{max}$ and Y. The output signal at the power value summation point 13, which is supplied to the power regulator 2, is thus Virtually zero, so that the power regulator stabilizes only small control deviations in the prior art configuration.

Details of the thirteenth function generator 62 will be best understood with the aid of FIG. 4a. With the circuit described, it is attained that the regulators 2, 3, 4 become inactive as much as possible, not only when the throttling $\epsilon$ is cancelled but also upon its resumption during the entire control process for varying the power of the power plant block.

From the circuit of FIG. 4a it can be seen that the signal embodying the predetermined load set point $P_{Sa}$ is the output signal of a second selection element 52, to which signals $d_1$ and $d_2$ are carried as input signals.

The signal $d_1$ is composed of the signal $d_1$ and an output signal $d_3$ of a first selection element 34, by means of a twenty-first summation point 53.

The signal $i_2$ is composed of the fuel-dependent power $P_B$ and an output signal $i_3$ of a fifth selection element 56, by means of a twenty-second summation point 55.

The response of an electric power $P_\epsilon a$ to the course over time of the control signal S is now simulated accurately by a fourteenth function generator 59. In other words, the transfer function $F_{PY}$ of the former 59 is identical to the control behavior of the controlled segment known as "block power P/valve stroke Y". The power component $P_\epsilon a$ is carried along with signals $d_4$, $i_4$ to the selection elements 34 and 56.

The signals $d_4$ and $i_4$ are output signals of a first steady-state function generator 57 and a second steady-state function generator 58, to which the control signal S is carried.

The signal $d_4$ is 0 when the control signal S is positive, and $d_4$ becomes strongly negative if the control signal S becomes negative.

The signal $i_4$ is 0 when the control signal S is negative, and $i_4$ becomes strongly positive if the control signal S becomes positive.

Figure 5:
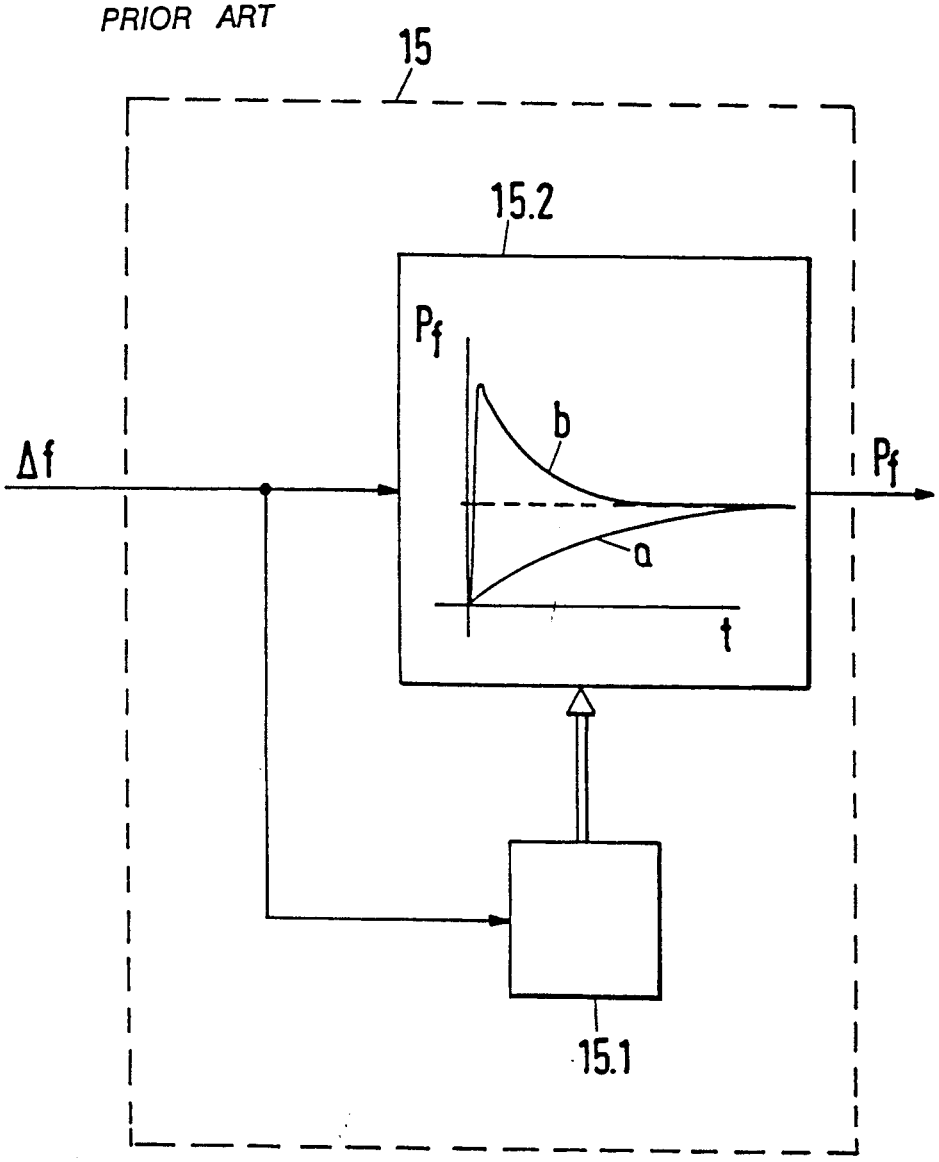
Fig.5 PRIOR ART
FIG. 5 is a diagrammatic view of a filter apparatus for fast changes in the network frequency.
Figure 6:
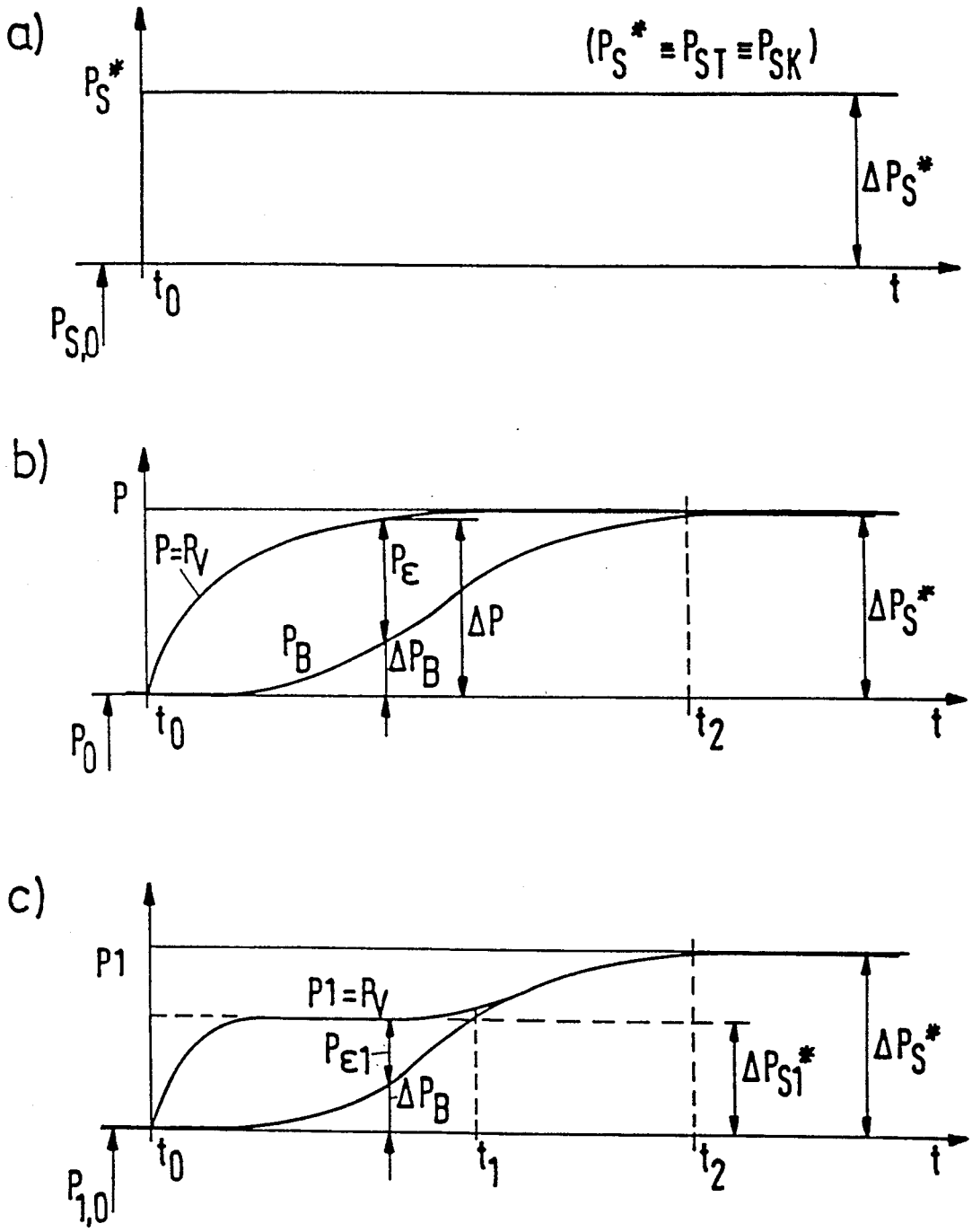
Fig.6 PRIOR ART
FIGS. 6a–6c are diagrams relating to the power behavior during a sharp rise in the specified power requirements.

The following description, with reference to FIGS. 4 and 5, will deal with the case of a discontinuous power increase.

The control signal S that is becoming positive is converted accurately into the signal $P_\epsilon a$, as described, which signal is passed through the fifth selection element 56 as a signal $i_3$. The signal $i_2$ produced by the twenty-second addition element 55 now becomes greater than the signal $P_B$. The signal $i_2$ is therefore passed on to the power regulator 2 as a predetermined load set point $P_{Sa}$ by the third selection element 54 and finally by the second selection element 52 as well, since the signals $d_1$ and $d_2$ are identical ($d_2=0$).

Upon restoration of the throttling $\epsilon_s$, the predetermined load set point $P_{Sa}$ remains unaffected by the control signal S, even if the control signal S is becoming less and less positive.

Although the signal $P_\epsilon a$ becomes negative here, the output signal $d_1$ of the third selection element 54 becomes identical to the signal of the fuel-dependent power portion $P_B$. Since once again the signals $d_1$ and $d_2$ are identical (always during the "power increase" regulating process), this signal also continues to determine the already-attained signal $P_{Sa}$.

Upon power reduction, the regulating process proceeds analogously to the case of a power increase. The functions of the selection elements 56 and 34 are transposed.

At the second control value summation point 10 in FIG. 4 upstream of the input of the position regulator 3, the trigger signal valve position Y, which comes from the output of the first control value summation point 9, is subtracted from the valve control signal S and from the valve control set point $Y_S$ coming from the valve position set point setter 11, so that the position regulator 3 remains inactive during the open-loop control process described. With the aid of the valve position set point setter 11, the trigger signal valve position Y and thus the throttling $\epsilon$ can be adjusted arbitrarily.

In order also to keep the pressure regulator inactive during the control process, the pressure set point signal D is sent from the output A3 of the process model 5 to the input of the pressure regulator 4; this signal has approximately the same course over time as the steam pressure signal $p_K$. The shutoff of the signal D is effected by addition to the output signal of the position regulator 3 at a thirteenth summation point 31, from the output signal of which, at the pressure value summation point 12, the steam pressure signal $p_K$ coming from the power plant block 1 is subtracted. The output of the summation point 12 is carried to the input of the pressure regulator 4. To form the pressure set point signal D, a third function generator 28 is provided in the process model 5. The valve control signal S is carried from the output of the power/position converter 21 to the third function generator 28. The third function generator 28 simulates the effect of the valve position change on the steam pressure. At a twelfth summation point 29, the output signal of the third function generator 28 is subtracted from the output signal of the fourth function generator 30, and the output of the twelfth summation point 29 is carried to the output A3 of the process model 5.

A situation will now be considered below in which only a small throttling $\epsilon_1$ is provided. The resultant energy reserve is inadequate for a strictly monotonic power increase, so that only a power course $P_1$ as shown in FIG. 6c is attainable. This is ascertained in the power amplitude limiter 16 from a previously calculated signal $\Delta P_{S\epsilon}$ in the process model 5, which signal is dependent on the instantaneous throttling $\epsilon=\epsilon_S-S$, on the (instantaneous) steam pressure $p_K$, and on the prevailing dynamic behavior of the power plant block 1; at time $t_0$, this signal has the value of the reduced power $\Delta P_{S1}$, and via a seventh summation point 18, at which the fuel-dependent power $P_B$ (for instance from the output of the second function generator 22) is added, and via a first selection element 17, this signal is carried to one input of the power amplitude limiter 16. As a result the amplitude of the output signal of the power amplitude limiter 16 is predetermined. The output signal of a sixth selection element 61 is also carried to the first selection element 17. As a result this output signal is stored in memory and thus cannot be reduced but instead only increases or remains constant.

On the basis of the signal $\Delta P_{S\epsilon}$, the power discontinuity in the power increase limiter 16 is accordingly limited, so that the energy reserve provided by the prevailing throttling $\epsilon_1$ is adequate for a strictly monotonic rise up to time $t_1$ to the level of the reduced power discontinuity $\Delta P_{S1}$. The required course of the strictly monotonic in block power P is predetermined by the first function generator 19. At time $t_1$ (FIG. 6c), the output signal of the first function generator 19 is identical to the fuel-dependent power $P_B$, so that the output signal $P_\epsilon$ at the eighth summation point 20 becomes 0. Since the signal $\Delta P_{S\epsilon}$ also becomes 0 from time $t_1$ on, and the signal $P_B$ alone is carried to the limiter 16 via the seventh summation point 18 and the first selection element 17, the signal at the output of the limiter 16 or function transducer 19 increases identically with the signal $P_B$, or in other words like the fuel-dependent power $P_B$ (FIG. 6c). The output signal $P_\epsilon$ at the eighth summation point 20 accordingly continues to remain 0.

When the block power P is attained at time $t_2$, the entire open- and closed-loop control process has not yet been concluded, since the throttling $\epsilon_S=Y_{max}-Y_S$ predetermined by the valve position set point setter 11 still remains to be resumed. During this resumption, the block power P at the output of the power plant block 1 should not vary, and the regulators 2–4 should continue to remain largely inactive. The resumption of the predetermined throttling $\epsilon_S$ is effected in a controlled manner. Thus the optimal instant for the starting of this procedure can be selected. In the example of FIG. 4, this process directly follows time $t_2$ (FIG. 6*b*), or begins shortly before it. However, if a low-pressure preheater train capable of being shut off is provided in the power plant (as shown in German Published, Non-Prosecuted Patent Application DE-OS 33 04 292), then first the preheater train is switched back on again, and the feedwater tank is filled, and then the throttling $\epsilon_S$ is resumed.

The function of the power/position converter 21 is, during a power increase phase, to convert the ascertained throttling-dependent power portion $P_\epsilon$ dynamically into the required course of the valve control signal S, so that the electrical power P produced does in fact vary as specified.

The converter 21 is composed of function units that take into account the storage capacity of the boiler and the dynamic behavior of the turbine set with intermediate overheating, and in principle breaks down into two function branches. One branch includes a dynamic element with compensation; the other branch has integral behavior. The signal S is fed back to this branch via a second branch, and the speed at which the signal S upon resumption of the throttling $\epsilon_S$ becomes 0 again is predetermined by the previously adjustable behavior of the feedback means. The two branches have a transfer function, which is approximately identical to the inverse transfer function between the electrical power or block power P and the trigger signal Y. It is "approximately" so, because the identical function cannot be achieved exactly. This slight inconsistency is eliminated by the activity of the power regulator 2.

During the resumption of the throttling $E_S$, pressure varies as a result of the reduction of the valve position Y from $Y_{max}$ to $Y_S$. In order not to impair the most recently attained electrical power P in this process, in this case the fuel delivery is raised again under control. This control is effected by the control signal S.

The pressure variation is compensated for at the input to the pressure regulator 3, in order to relieve the pressure regulator 3 as much as possible. The compensation signal required is the output signal of the third function generator 28. The signal S is continuously present at the input of the function generator 28.

The exemplary embodiments described thus far relate to a closed-loop control concept in which the turbine inlet valve is associated with the power regulator 2, as the primary control element. This kind of block operation is generally known as "turbine leads, boiler follows".

On the other hand, "boiler leads, turbine follows" means a mode of block operation in which the fuel, as the control variable, is assigned to the power regulator 2.

The block operating mode "turbine leads, boiler follows" thus far described provides a better outcome in terms of maintaining the block power P if a heating malfunction arises (for example from a varying thermal value of the fuel). Contrarily, the block operating mode "boiler leads, turbine follows" furnishes a better result in terms of stabilizing the boiler pressure. In principle, however, the method of the invention is suitable for both block operating modes. A circuit adapted to the "boiler leads, turbine follows" block operating mode is known from the afore-mentioned German patent in FIG. 9 thereof.

Principally, the basis is the same process model 5 as in FIG. 4. The device is upstream of the inputs E1 and E2 of the process model 5 are likewise identical. The only differences are in the relationship of the regulators 2, 3, 4 to the process model 5 in the power plant block 1. The position regulator 3, the output of which furnishes the trigger signal Y for the valve position, which is delivered as a control signal to the power plant block 1 and is also fed back to the second control value summation point 10, is connected to the output A2 of the process model 5 that furnishes the valve control signal 5. The valve command $Y_S$ from the valve position set point setter 11 is also delivered to the second control value summation point 10. The valve position set point $Y_S$ is then carried to an input E3 of the process model 5.

The power regulator 2 is connected via the power value summation point 13 to the output A4 of the process model 5, which furnishes the predetermined load set point $P_{Sa}$. Also supplied to the power value summation point 13 is the electrical power P from the output of the power plant block 1. The output of the power regulator 2 is carried to the pressure regulator 4 via the pressure value summation point 12. The output A3 and the steam pressure signal $p_K$ is also carried to the pressure value summation point 12. As in FIG. 4, the output of the pressure regulator 4 is connected to the fuel value summation point 8, to which the fuel control signal B is also carried, and which furnishes the control signal for the fuel flow rate $m_B$ to the power plant block 1.

To improve the dynamic behavior upon a sudden reduction in network frequency, a nonlinear adaptive filter device, which is schematically shown in FIG. 5, is therefore provided as a filter 15 for forming the set point component $P_{f1}$ in the configuration according to the invention shown in FIG. 4. This filter device 15 is distinguished by the fact that its behavior upon a drop in network frequency changes from PT1 to PDT1. The filter device 15 shown in FIG. 5 includes a detector device 15.1 for this purpose, to detect a dip in frequency and to cause the change in function of the filter 15.2 from a PT1 behavior a to a PD behavior b. Not until a new steady state is attained does the PT1 behavior a become operative again. With the set point component $P_{f1}$ formed in the filter 15, the dynamics of the power plant block provided with the apparatus shown in FIG. 4 and described below be employed to their full extent for primary frequency regulation.

The first power set point component $P_{f1}$ is delivered to the guide variable summation point 7 with a negative algebraic sign; there the component $P_{f1}$ is added to the power set point $P_S$ output by the set point setter 6, as a result of which a power set point for the turbine $P_{ST}$ is produced that is delivered to the input E2 of the process model 5.

The second power component $P_{f2}$ is delivered to the second guide variable summation point 32 with a negative algebraic sign and is added there to the load set point $P_S$. The result is a load set point $P_K$ for the boiler, which is carried to the input E1 of the process model 5.

Figure 7:
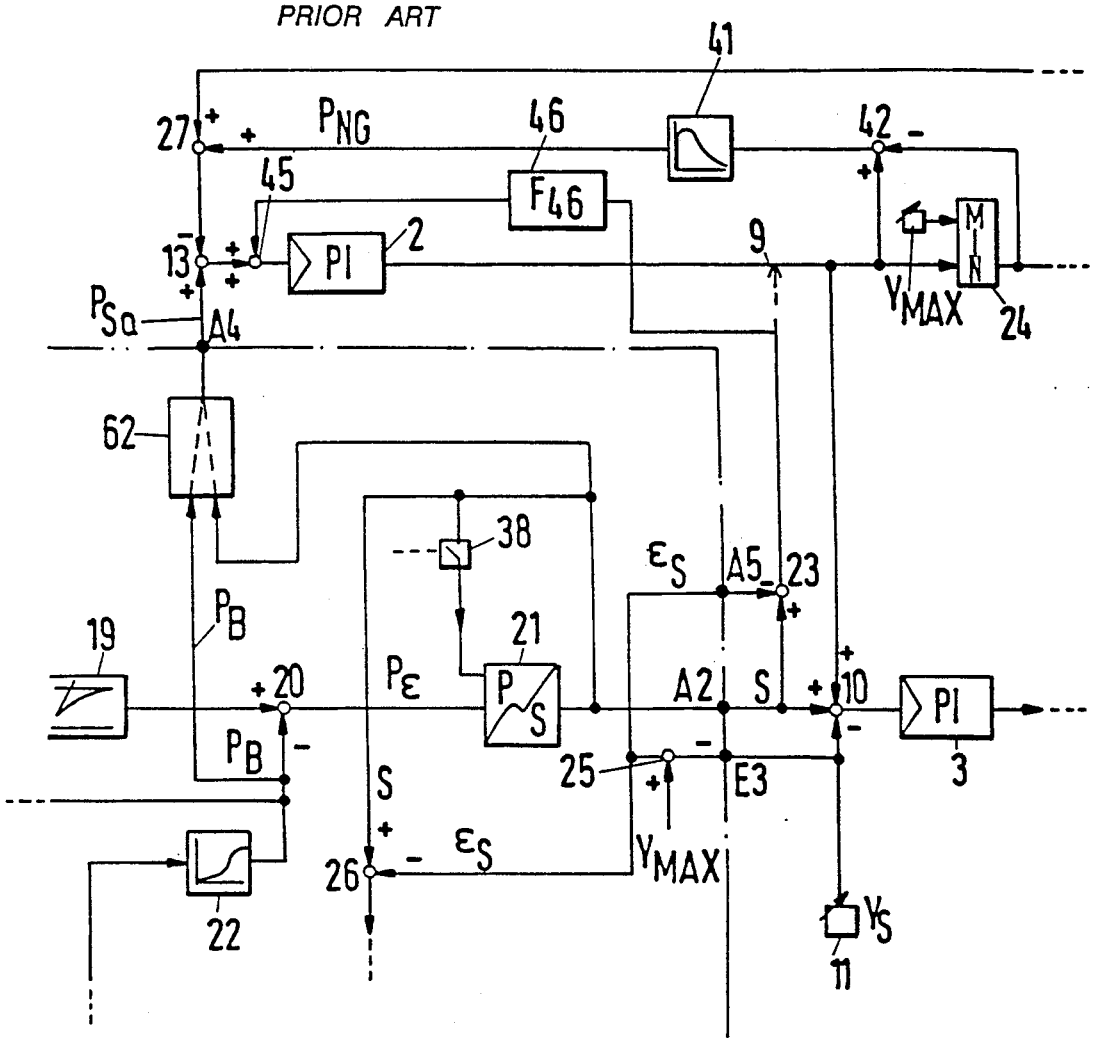
Fig.7 PRIOR ART
FIGS. 7, 8 and 10 are variant prior art circuits for parts of the block diagram shown in FIG. 4.
Figure 8:
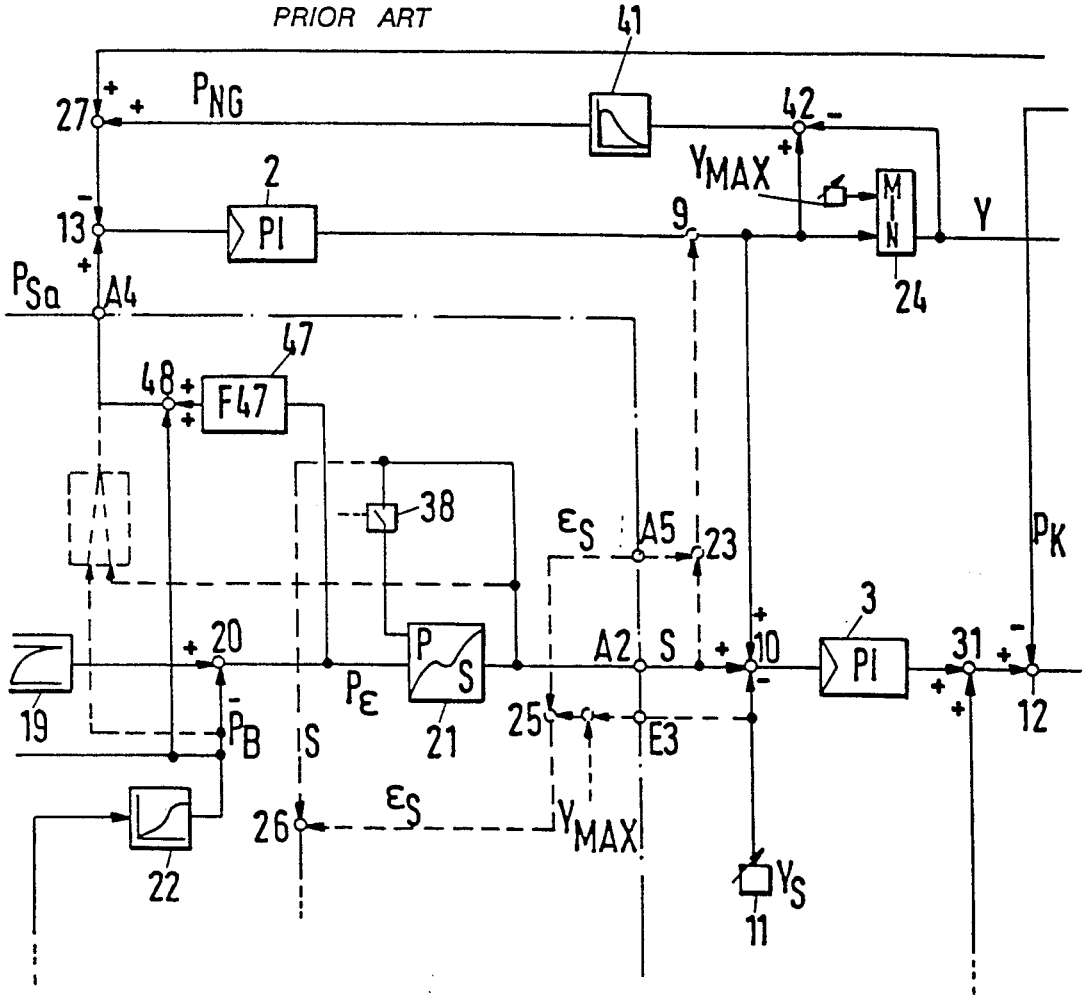
Fig.8 PRIOR ART
Figure 10:
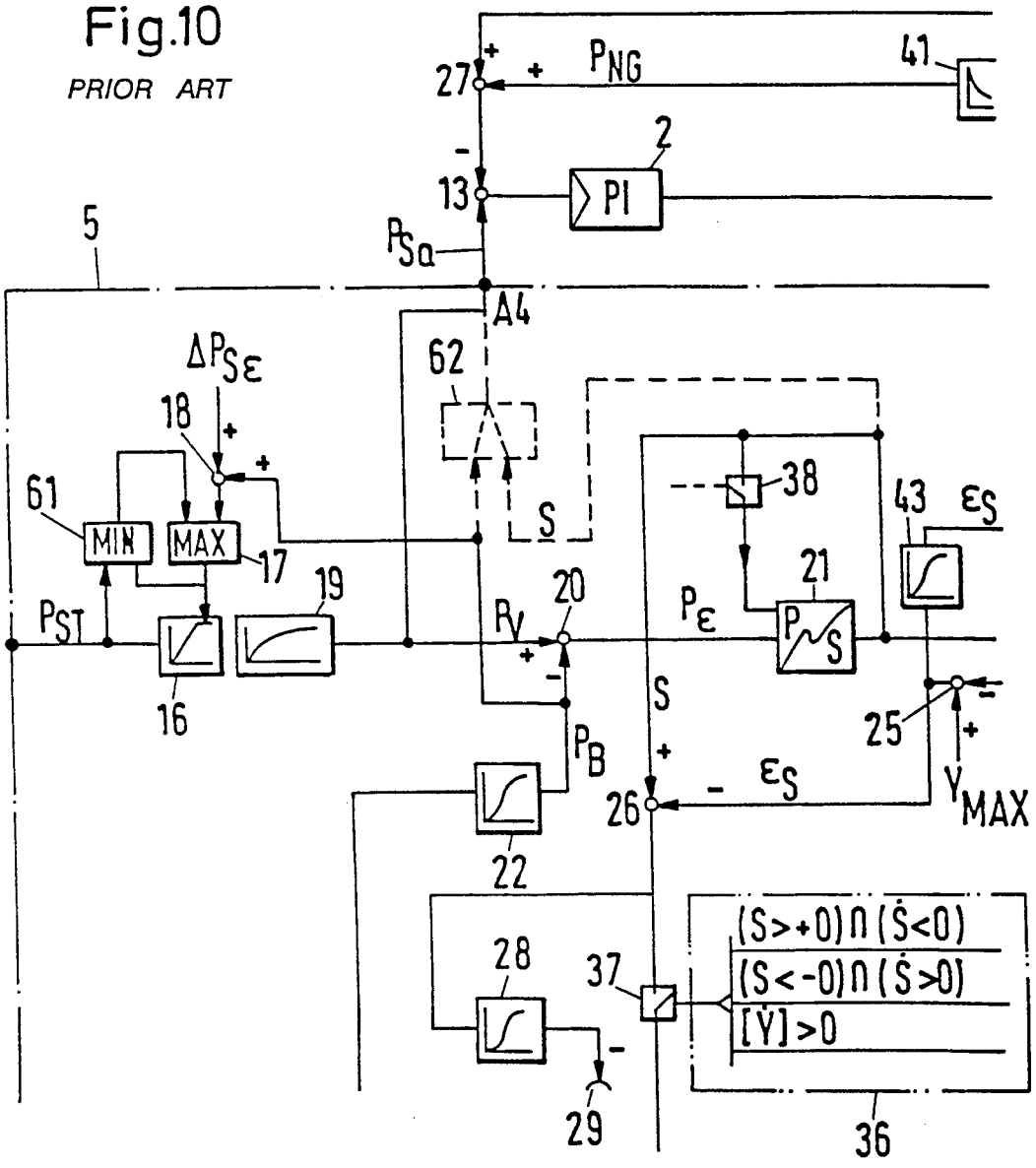
Fig.10 PRIOR ART

The method according to the invention can be realized for instance with the variant embodiments shown in FIGS. 7, 8 and 10, or by combining these variants.

FIG. 7 shows a detail of the block diagram shown in FIG. 4 in which a circuit variant is shown. Connections that are omitted in this variant are represented by dashed lines, and new circuit elements are emphasized with heavy lines. The output signal of the ninth summation point 23 in this variant is carried not to the first summation point 9 but rather, via an eleventh function former 46, to a nineteenth summation point 45 which is disposed upstream of the power regulator 2. The eleventh function generator 46 has a transfer function $F_{46}=1/F_R$ that is reciprocal to the function of the power regulator 2. As can easily be seen, the total function in this circuit variant does not change, since the valve position variation $\Delta Y$ has an identical course over time to that of the control signal S.

FIG. 8 again shows a detail of the block diagram shown in FIG. 4, in which an embodiment of the circuit is shown that applies to the predetermining of the load set point $P_{Sa}$, the resumption of the throttling $\epsilon_S$, and the adjustment of the valve position set point $Y_S$. The output signal of the eighth summation point 20 is carried to the output A4 of the process model 5, via a twelfth function former 47 and an eighteenth summation point 48. At the eighteenth summation point 48, the power set point $P_{Sa}$ is composed of the fuel-dependent power $P_B$ and the output signal of the twelfth function former 47. Connections shown in dashed lines are eliminated. The transfer function of the twelfth function former 47 is then $$F_{47} = \frac{1 + F_R F_S}{F_R F_S}$$

in which $F_R$ is the transfer function of the power controller 2 and $F_S$ is the inverse transfer function of the power/position converter 21. Here the signal Y is again controlled indirectly in an alternative way, in other words by means of the power regulator 2. The variation $\Delta Y$ again has a course over time identical to that of the signal S.

The circuit variant shown also has the effect that the resumption of the throttling $\epsilon_S$ takes place not upon the simultaneous fuel correction by addition by the seventh function former 39, or that an adjustment of the valve position Y is not controlled directly by the set point $Y_S$, nor that the fuel is corrected by the addition of the function former 39, but rather the valve position Y is changed to $Y_S$ after work by the control activity of the position regulator 3 and the pressure regulator 4. However, the method according to the invention does not change as a result of this circuit variant.

Nor does the method of the invention change even if the compensation signal, that is, the predetermined load set point $P_{Sa}$ for the power regulator 2, is not derived from the signals $P_B$ and $P_\epsilon a$, which furnish the—simulated—power responses to the actual variations of the control signals B and S, but rather, as shown in FIG. 10, the signal $P_{Sa}$ is made identical to the signal from the output of the first function former 19. In this circuit, although the accurate effect of the control signal S upon the electrical power can be taken into account only approximately by means of the signal $P_{Sa}$, so that the control activity of the power regulator 2 and thus of the further regulators 3 and 4 as well must necessarily be taken more markedly into account, on the other hand the predetermined course of the power $P_V$, which is the output signal of 19 and here is identical with $P_{Sa}$, can in turn be adhered to more accurately. The function generator 62 shown in dashed lines in FIG. 10 is omitted in this circuit variant.

The exemplary embodiments described thus far relate to a closed-loop control concept in which the turbine inlet valve is associated with the power regulator 2, as the primary control element. This kind of block operation is generally known as "turbine leads, boiler follows".

On the other hand, "boiler leads, turbine follows" means a mode of block operation in which the fuel, as the control variable, is assigned to the power regulator 2.

The block operating mode "turbine leads, boiler follows" thus far described provides a better outcome in terms of maintaining the block power P if a heating malfunction arises (for example from a varying thermal value of the fuel). Contrarily, the block operating mode "boiler leads, turbine follows" furnishes a better result in terms of stabilizing the boiler pressure. In principle, however, the method of the invention is suitable for both block operating modes.

Figure 9:
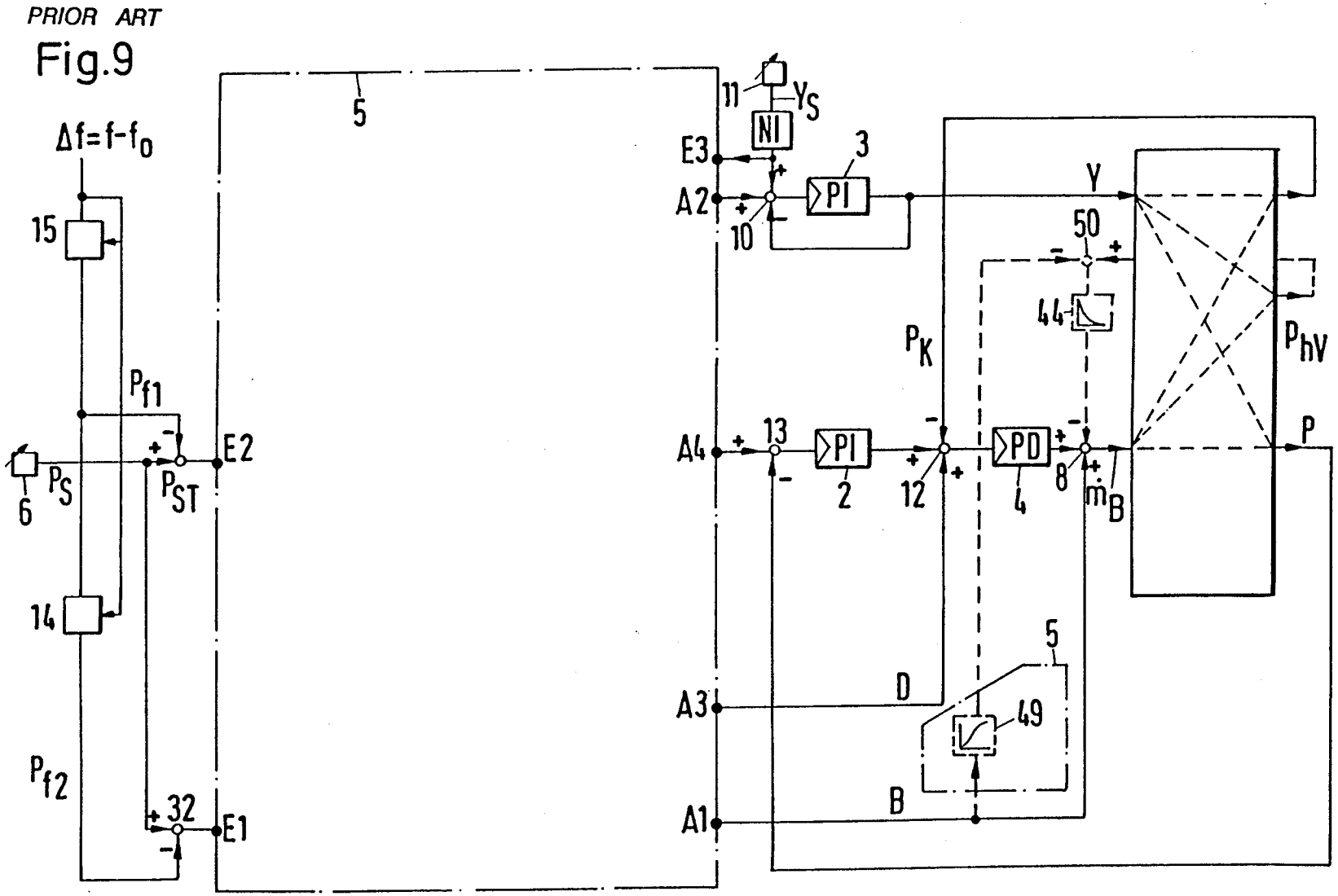
PRIOR ART Fig.9
FIG. 9 is a block diagram for an apparatus for performing the method in the block operating mode "boiler leads, turbine follows".

A circuit adapted to the "boiler leads, turbine follows" block operating mode is shown in FIG. 9. The basis is the same process model 5 as in FIG. 4. The device is upstream of the inputs E1 and E2 of the process model 5 are likewise identical. The only differences are in the relationship of the regulators 2, 3, 4 to the process model 5 in the power plant block 1. The position regulator 3, the output of which furnishes the trigger signal Y for the valve position, which is delivered as a control signal to the power plant block 1 and is also fed back to the second control value summation point 10, is connected to the output A2 of the process model 5 that furnishes the valve control signal 5. The valve command $Y_S$ from the valve position set point setter 11 is also delivered to the second control value summation point 10. The valve position set point $Y_S$ is also carried to the input E3 of the process model 5.

The power regulator 2 is connected via the power value summation point 13 to the output A4 of the process model 5, which furnishes the predetermined load set point $P_{Sa}$. Also supplied to the power value summation point 13 is the electrical power P from the output of the power plant block 1. The output of the power regulator 2 is carried to the pressure regulator 4 via the pressure value summation point 12. The output A3 and the steam pressure signal $p_K$ is also carried to the pressure value summation point 12. As in FIG. 4, the output of the pressure regulator 4 is connected to the fuel value summation point 8, to which the fuel control signal B is also carried, and which furnishes the control signal for the fuel flow rate $m\epsilon_B$ to the power plant block 1.

If the fresh steam pressure downstream of the boiler or upstream of the turbine is regulated with the aid of the steam pressure signal $p_K$, then a differential signal formed at a twentieth summation point 50—between the steam pressure signal $p_{hV}$(downstream of the evaporator) and the output signal of the tenth function former 49 is delivered to the fuel value summation point 8 via the derivative-action element 44.

As already noted, particularly with respect to the instant invention, a resumption of the turbine throttling represents a reduction of the control signal S to the value of zero (in the sliding pressure mode). The signal S is the output signal of the process model 5 at its output A2. According to the invention, this reduction is no longer open-loop-controlled but rather regulated, i.e.

closed-loop controlled, within the context of the process model 5. The associated closed control loop or circuit includes a regulator 63, to which the output signal $S_Y$ of the power/position converter 21 is sent as a control variable. Since the output signal $S_S$ of an eighteenth function generator 74 in the sliding pressure range is 0, then the signal S is also 0. The output signal of the regulator 63 is carried to a twenty-third summation point 64, where it is additively linked with the output signal of a fifth function generator 33 for forming a fuel control signal B. The fuel control signal B is carried via a twenty-sixth summation point 77 and a second function generator 22 and via a twenty-seventh summation point 78 as a fuel-dependent power signal $P_B$ via an eighth summation point 20, and after linkage there with a further power signal $P_V$ is carried as a throttling-dependent power signal $P_\epsilon$ to the input of the power/position converter 21, whereby the control circuit is closed.

As long as the output signal $S_Y$ of the converter 21 has a positive value, the regulator 63 effects an increase in fuel delivery. This is detected by the second function generator 22, as a result of which the fuel-dependent power signal $P_B$ is increased. Since the signal $P_B$ is subtracted from the signal $P_V$ in the summation point 20, the output signal $P_\epsilon$ of the summation point 20 becomes smaller until it is finally negative, for a constant signal $P_V$. The negative signal $P_\epsilon$ drives the positive signal $S_Y$ to zero. In the sliding pressure mode, the output signal of the function generator 74 is zero, and thus the signal S is also optimally regulated to the value of zero by the control circuit. Physically, the closed-loop control process means that the thermal energy delivered to the boiler by the fuel is immediately stored by the closure of the turbine regulating valves; thus the fresh steam pressure rises, but the power of the steam turbine and thus the electrical power as well remain constant during this process. The devices for regulating the electrical power therefore need not be active.

The regulator 63 can be achieved with various structures. For instance, it may be a P controller, i.e. a proportional action controller. A version shown in the drawing as a PD regulator, i.e. a proportional and derivative action controller. The D component of the PD controller is controlled by a logic circuit 65. The D component becomes active only when the logic circuit 65 furnishes a logical 1. As a result, the reduction of the signal $S_Y$ or S to zero is particularly advantageously damped. The logic circuit 65 furnishes a 1, whenever one of the two following conditions are satisfied:

1. The control signal $S_Y$ to be regulated is positive and higher than a predetermined value $S_0>0$, and $S_Y$ varies in the negative direction ($S_Y'<0$).
2. The control signal $S_Y$ to be regulated is negative, and $S_Y$ is less than a predetermined negative value ($-S_0$), and $S_Y$ varies in the positive direction ($S_Y'>0$).

This means that the logic circuit furnishes a 1 when the combination $S_Y>S_0$, $S_Y'<0$ is simultaneously present, or the combination $S_Y<-S_0$, $S_Y'>0$ is simultaneously present.

German Patent 36 32 041 describes how, if a low-pressure preheater train capable of being shut off is present, then first the preheater train is turned on again and the feedwater tank filled; only then is the throttling resumed. This means that the otherwise constant feedback of the control signal S is in this case not added until later, namely once the feedwater tank has been refilled, or once its water level approaches the normal water level.

Another special feature should also be explained, which results from a division of the power control range, which for instance includes from 45 to 100% of the rated output, into a sliding pressure range and a fixed pressure range. In the sliding pressure range, the fresh vapor pressure varies; in the fixed pressure range, the vapor pressure is regulated to its rated value. In the fixed pressure range, the position regulator 3 that in the sliding pressure range specifies the sliding pressure set point value to the pressure regulator 4 disposed below it is not turned on. In the fixed pressure range, signal D furnishes the fixed pressure set point. Also in the fixed pressure range, the turbine control valve is purposefully controlled by the valve control signal S.

In the case where the power regulating range is divided in this way, the valve control signal S should not be brought to the value of 0 in every operating case, but rather to a positive valve control signal set point $S_S=f(P_S, Y_S)$, which depends in terms of the principle on the load set point $P_S$ and the valve position set point $Y_S$. This signal $S_S$ is furnished by the function generator 74. If a case is for instance considered in which a sudden 5% power increase is attained and in which the output power is in the sliding pressure range, yet the final power, that has been raised by 5%, is located in the fixed pressure range, then the original turbine control reserve, for instance the throttling of the turbine inlet valves, cannot be resumed, since in accordance with the final power, the fresh steam pressure must not be set fixedly beyond the rated value. In this case, it is not the valve position signal S that is brought to 0, but rather only the signal $S_Y$, so that the signal S becomes identical to $S_S$, which is positive. In the sliding pressure range, the signal $S_S$ has the value of 0.

In closing, the modification or expansion of the process model for a combined fixed and sliding pressure mode according to the invention will be described. The combined fixed and sliding pressure mode is described per se in the publication VGB Kraftwerkstechnik 69, No. 9, Sept. 1989, pp. 892–895.

In this combined mode, the entire power regulating range is composed of one range with sliding fresh steam pressure, which extends as far as a so-called disconnection block power, and a power range above that with fixed fresh steam pressure. The disconnection block power is equivalent to the turbine power with the last or last two turbine control valves completely closed. A steam turbine suitable for a combined mode has nozzle group regulation, in which each turbine regulating valve supplies only one segment of a distributor with steam.

The turbine regulating valves are generally opened in succession, or in other words not simultaneously as in the case of throttle control. The result is a relatively wide partial power range, which is operated with fixed pressure, the dynamic behavior of the power plant block varies at the transition from the sliding pressure mode to the fixed pressure mode. This feature is taken approximately into account in the adaptation of the process model according to the invention.

While the valve control signal S in the sliding pressure mode assumes the value of 0 again at the end of the regulating process for the resumption of the turbine control reserve, the signal S remains positive in the fixed pressure range, as already noted. Its value is approximately proportional to the block power difference P—$P_T$, where P is greater than $P_T$. P is the electrical power output by the power plant block, and $P_T$ is the disconnection power. In the fixed pressure range, a certain position of the last or last two turbine regulating valves closed in the sliding pressure mode corresponds to the value of the signal S. Since the fresh steam pressure in the fixed pressure mode is at its rated value, a greater block power P than $P_T$ can be attained only by opening the last or last two turbine regulating valves. This operating mode has the advantage, compared with throttle regulation, that the turbine control reserve is furnished without a loss of efficiency.

In the process model 5, this operating mode is attained by means of devices described below; here, only the basic mode of operation can be described. The output signal of a twentieth function generator 80 has the physical meaning of "fresh steam pressure". With the aid of a limit value controller or threshold value regulator 71, this "fresh steam pressure" signal is regulated at the output of the summation point 73 to a set point defined at a set point setter 72 and delivered via a twenty-ninth summation point 81, if the output signal of the function generator 80 is higher than the fresh steam pressure rated value set at the set point setter 22. As a result, a correct value for the pressure set point signal D that is output at the output A3 of the process model 5 is also formed via the twelfth summation point 29. At the transition to the fixed pressure range, the signal D in fact forms the sole set point for the pressure regulator 4. At the same time, upon this transition, the position regulator 3 is switched off, and as a result the output signal of the thirteenth summation point 31 simultaneously becomes the signal D.

In contrast to the PD behavior disclosed in German Patent 36 32 041, the pressure regulator 4 in the arrangement according to the invention exhibits P behavior (proportional control), and an I component can be added. This I component is blocked in the sliding pressure mode and is enabled upon the transition to the fixed pressure mode.

The positive value of the signal S existing in the fixed pressure mode is determined by the output signal $S_S$ of the function generator 74. The output of the converter 21 that via a twenty-eighth summation point 79 also acts upon the output A2 or in other words the signal S is in fact brought to the value of zero as in the sliding pressure mode. In the new steady state at the end of the regulating process for resumption of the turbine control reserve, the value of the output signal $S_Y$ of the converter 21 is accordingly zero, and the signal S is greater than zero, if the block power P is above the disconnection power $P_T$.

The differing dynamic behavior of the block power in the fixed pressure range compared with the sliding pressure range is taken into account in the process model 5 by means of a nineteenth function generator 75 and finally by means of the eighteenth function generator 74 as well.

The D component that is eliminated from the pressure regulator 4—as mentioned above—is replaced in the arrangement of the invention by a fourteenth function generator 66. Via the fuel value summation point 8, it acts negatively upon the fuel flow rate. This is taken into account in the process model 5 by means of a fifteenth function generator **66*b*, which has an identical transfer function to that of the function generator 66**.

The situation is correspondingly true for a twenty-first function generator **44*b*, which simulates the D imposition of the steam pressure $p_{hV}$ downstream of the evaporator of the forced circulation boiler of block 1, which is achieved with the derivative-action element 44, in the process model 5. It follows that the output signal of a twenty-fourth summation point 69 in the model 5 must "physically" furnish the simulated steam pressure $p_{hV}$. The simulation required for this is effected by means of a sixteenth function generator 67 (on the fuel side) and a seventeenth function generator 68** (on the turbine valve side).

A twenty-fifth summation point 70 and a twenty-sixth summation point 77 in the process model 5 correspond to the fuel value summation point 8, without taking the output signal of the pressure regulator 4 into account. The process model 5 does not in fact include any pressure regulator. For control purposes, the regulation has only a corrective function; in the ideal case, the regulation remains inactive.

I claim:

1. In a method for controlling the power of a steam power plant block operated in combined variable-pressure and constant-pressure operation which method comprises forming a fuel control signal and a turbine inlet valve control signal in accordance with a predetermined process model, a method for restoring a predetermined turbine adjustment reserve by turbine inlet valve throttling after a stabilization of a sudden elevation in a load set point of the steam power plant block, which comprises:

returning the turbine inlet valve control signal to zero in a regulated manner after the stabilization of the load set point elevating and after restoring the predetermined turbine adjustment reserve in the variable-pressure power plant operation, by amplifying an output signal of a power/position converter in a regulated manner;

utilizing the amplified output signal of the power/position converter as an additive component for forming a fuel control signal;

forming a chronological curve of the power plant output with a function generator in dependence of a fuel supply; and feeding back the fuel control signal to an input of the power/position converter through the function generator.

2. The method according to claim 1, which comprises utilizing a PD regulator as the regulator having P and D components in the regulated amplifying step, activating the D component only whenever a logic circuit furnishes a logical 1, furnishing a logical 1 with the logic circuit if the output side to be regulated is more positive than a predetermined value and varies in the negative direction, or if the output signal is negative and smaller than a predetermined value and varies in the positive direction.

3. In a method for controlling the power of a steam power plant block operated in combined variable-pressure and constant-pressure operation which method comprises forming a fuel control signal and a turbine inlet valve control signal in accordance with a predetermined process model, a method for restoring a predetermined turbine adjustment reserve by turbine inlet valve throttling after a stabilization of a sudden elevation in a load set point of the steam power plant block, which comprises:

returning the turbine inlet valve control signal to a predetermined valve control set point value in a regulated manner after the stabilization of the load set point elevation and after restoring the predetermined turbine adjustment reserve in the constant-pressure power plant operation, by amplifying an output signal of a power/position converter in a regulated manner;

utilizing the amplified output signal of the power/position converter as an additive component for forming a fuel control signal;

forming a chronological curve of the power plant output with a function generator in dependence of a fuel supply; and feeding back the fuel control signal to an input of the power/position converter through the function generator.

4. The method according to claim 3, which comprises utilizing a PD regulator as the regulator having P and D components in the regulated amplifying step, activating the D component only whenever a logic circuit furnishes a logical 1, furnishing a logical 1 with the logic circuit if the output side to be regulated is more positive than a predetermined value and varies in the negative direction, or if the output signal is negative and smaller than a predetermined value and varies in the positive direction.

5. Apparatus for regulating the power of a steam power plant block by utilizing a steam reserve available as a turbine adjustment reserve for briefly raising the power, comprising a regulator having an input and an output, a power/ position converter for forming a turbine inlet valve control signal to be fed to said input of said regulator, means for additively linking a signal from said output of said regulator with a further signal for forming a fuel control signal, a function generator receiving said fuel control signal for generating a function signal, summation point means for forming a summation signal by linking said function signal with a signal dependent on a load set point, and means for delivering said summation signal to said power/position converter as an input signal.

6. The apparatus according to claim 5, wherein said regulator is a PD regulator having a P and a D component, and including a logic circuit connected to said PD regulator for controlling said D component as a function of predetermined conditions.

* * * * *